US007331807B2

(12) United States Patent
Scholler et al.

(10) Patent No.: US 7,331,807 B2
(45) Date of Patent: Feb. 19, 2008

(54) ELECTRICAL PLUG-IN CONNECTION

(75) Inventors: Johann Scholler, Deggendorf (DE); Sonja Fredl, Deggendorf (DE)

(73) Assignee: Coninvers Elektrotechnische, Herrenberg (DE)

( * ) Notice: Subject to any disclaimer, the term of this patent is extended or adjusted under 35 U.S.C. 154(b) by 0 days.

(21) Appl. No.: 11/488,410

(22) Filed: Jul. 17, 2006

(65) Prior Publication Data

US 2007/0037429 A1 Feb. 15, 2007

(30) Foreign Application Priority Data

Jul. 16, 2005 (EP) ..... 05015503

(51) Int. Cl.
*H01R 13/62* (2006.01)

(52) U.S. Cl. ..... 439/320

(58) Field of Classification Search ..... 439/320, 439/322, 323, 312

See application file for complete search history.

(56) References Cited

U.S. PATENT DOCUMENTS 2,961,630 A * 11/1960 Duncan ..... 439/318
3,994,552 A * 11/1976 Selvin ..... 439/278
5,435,760 A 7/1995 Miklos
5,439,386 A 8/1995 Ellis et al.
5,827,078 A * 10/1998 Simonian ..... 439/95
6,135,800 A 10/2000 Majors
6,957,972 B2 * 10/2005 Starke et al. ..... 439/320

FOREIGN PATENT DOCUMENTS

| | | |
|---|---|---|
| DE | 199 04 037 | 8/2000 |
| EP | 1 524 732 | 4/2005 |
| GB | 2 314 391 | 12/1997 |

* cited by examiner

*Primary Examiner*—Neil Abrams
*Assistant Examiner*—PhuongChi Nguyen
(74) *Attorney, Agent, or Firm*—Bachman & LaPointe, P.C.

(57) ABSTRACT

Electrical plug-in connection (1), having a plug part (2) and a mating plug part (3), which can be plugged together and produce a large number of electrical plug-in connections, at least the plug part (2) or the mating plug part (3) bearing, on its body (19, 24), a union nut (4), which can be screwed to the mating plug part (3) or the plug part (2) and secures the plug-in connection (1) against becoming disconnected in an undesirable manner. The union nut (4) has, at both of its ends, an internal thread (28, 7) for simultaneously screwing it to the plug part (2) and the mating plug part (3), the internal threads (7, 28) being formed in the opposite direction.

10 Claims, 3 Drawing Sheets

ELECTRICAL PLUG-IN CONNECTION

BACKGROUND OF THE INVENTION

The invention relates to an electrical plug-in connection, comprising a plug part and a mating plug part, which can be plugged together and produce a large number of electrical connections, at least the plug part or the mating plug part bearing, on its body, a union nut, which can be screwed to the mating plug part or the plug part and secures the plug-in connection against becoming disconnected in an undesirable manner, the union nut having, at its ends, an internal thread for screwing it to the plug part and the mating plug part, and the internal threads being formed in the opposite direction.

Such plug-in connections are generally known and are in use and are preferably used in the construction of electrical appliances, machines, vehicles and systems. The intention is therefore to provide the fitter or the user with a possibility of producing or detaching an electrical connection simply, rapidly and safely. In this case, the connection technology is designed such that it safely connects the contact elements electrically to one another and protects any personnel coming into contact with the plug-in connection against hazardous voltages. For this purpose, plug-in connections are often used which comprise a multi-pole plug part with female contact connectors and a multi-pole mating plug part with male contact connectors, which are designed such that they largely protect the electrical contact elements against mechanical and atmospheric influences.

It is known in this case to secure the plug part and the mating plug part against becoming disconnected in an undesirable manner by means of a union nut. For this purpose, the union nut, which is borne, for example, by the plug part, is screwed onto an external thread of the mating plug part until it reaches an axial stop and is tightened firmly. A sealing ring is often provided between the plug part and the mating plug part, which sealing ring is pinched when the plug connection is plugged together or when the union nut is screwed on and seals the plug part and the mating plug part with respect to one another. In addition, the sealing ring may act as a friction brake for the union nut and prevent the screw connection from becoming detached in the event of vibrations. In this case, O rings have proven particularly successful as sealing rings and as a friction brake during manufacture and in industrial use.

One disadvantage of these known plug-in connections is the time required for screwing and unscrewing the union nut when producing or when disconnecting the plug-in connection. Another disadvantage is the fact that, in the case of a sealing ring which is arranged between the front faces of the plug part and the mating plug part, the sealing ring is not always pinched such that it seals the annular gap between the plug part and the mating plug part reliably against the ingress of moisture. This is particularly the case when plug parts and mating plug parts of various manufacturers which are conventional on the market are used in pairs, since in this case there is often a slight play. This also results in the union nut becoming detached by means of vibration movements.

However, stringent requirements as regards the robustness, resistance to vibration, the ability for them to be fitted rapidly and sealtightness are placed on the above plug-in connectors for industrial use.

SUMMARY OF THE INVENTION

The invention is based on the object of improving a plug-in connection of the type mentioned initially such that the above-described disadvantages are reliably avoided; in particular, firstly, the union nut is reliably prevented from becoming detached by means of vibration movements and, secondly, it is possible for it to be fitted rapidly with as few rotary movements as possible.

This object is achieved according to the invention by a plug-in connection having a plug part (2) and a mating plug part (3), which can be plugged together and produce a large number of electrical connections, at least the plug part (2) or the mating plug part (3) bearing, on its body (19, 24), a union nut (4), which can be screwed to the mating plug part (3) or the plug part (2) and secures the plug-in connection (1) against being disconnected in an undesirable manner, the union nut (4) having, at both of its ends, an internal thread (28, 7) for screwing it to the plug part (2) and the mating plug part (3), and the internal threads (7, 8) being formed in the opposite direction, characterized in that at least one of the two internal threads (7, 28) of the union nut (4) is segmented and, on the side facing the front faces (31, 38) of the union nut (4), has a first thread turn (40) having a cross-sectional profile which is different than the thread turns of the external threads (6, 20) and cannot be brought into engagement with the thread (6, 20) of the mating plug part (3) or the plug part (2). Further advantageous refinements are described herein.

Accordingly, the plug-in connection according to the invention has a union nut with internal threads at its ends which are formed in the opposite direction, in the case of which at least one of the two internal threads is segmented, and the segmented internal thread, on the side facing the front faces of the union nut, has a first thread turn having a cross-sectional profile which is different than the thread turns of the external thread of the plug part or mating plug part.

The union nut with the two internal threads is provided for screwing the electrical plug-in connection, one of the two internal threads being provided for screwing to the plug part and the other internal thread being provided for screwing to the mating plug part. The internal threads of the union nut are arranged opposite one another and extend up to the front sides of the union nut. They are formed in the opposite direction and have an identical thread pitch.

The segmented internal thread of the union nut has at least one thread-free region, which extends in the plug-in direction, can be inserted virtually completely into an external thread, having a complementary design, of the associated plug part or mating plug part and reduces the number of revolutions of the union nut for screwing it tight.

In order to screw the plug-in connection, the external threads of the plug part and the mating plug part, which correspond to the internal threads of the union nut, are together brought into engagement with the two internal threads of the union nut. When the union nut is rotated, the plug part and the mating plug part are moved simultaneously with respect to one another in the direction of the center of the union nut until the body of the plug part comes into contact with the body of the mating plug part and the electrical connections are produced. In comparison with a union nut with only one internal thread which can be screwed on one side, in this case the number of revolutions required for screwing the plug-in connection is reduced by half, which saves on time. In addition, the front sides of the plug part and the mating plug part are moved twice as far towards one another in comparison with conventional plug-in connectors given a predetermined rotation angle or number of revolutions of the union nut.

The first thread turn of the segmented internal thread of the union nut cannot be brought into engagement with a thread turn of the external thread of the mating plug part or plug part if a contact carrier of the plug part has not been completely inserted into a thread sleeve of the mating plug part. This ensures that, when the plug-in connection is screwed, the electrical connections between the plug part and the mating plug part are produced.

The plug part and the mating plug part advantageously have external threads on their body which are designed to be complementary with respect to the threads of the union nut. It is thus possible for the thread-free region of the internal thread of the union nut, which extends in the plug-in direction, to be inserted virtually completely into the external thread, having a complementary design, of the associated plug part or mating plug part and the screw-tightening is reduced to a rotation of the union nut by at most the thread-free region. One further advantage is the fact that the plug part and the mating plug part can be plugged together and the electrical connection produced without the plug-in connection needing to be screwed. This may be useful, for example, when bringing electrical appliances and systems into operation and during faultfinding processes on said electrical appliances and systems if, in the event of a fault, the plug-in connection needs to be detached quickly and a faulty part replaced. After successful testing or after elimination of faults, the plug part and the mating plug part are connected to one another quickly, safely and permanently by rotating the union nut.

In one preferred embodiment, the union nut is fixed on the body of the bearing plug part or mating plug part such that it can be rotated and displaced. The union nut is therefore secured against being lost, on the one hand, and, on the other hand, it is possible to insert it into a thread-free region of the thread of the bearing plug-in connector part, which has an advantageous effect on the fitting time when producing the plug-in connection. If both the two internal threads of the union nut and the corresponding external threads of the plug part and the mating plug part are of segmented design, the electrical connection between the plug part and the mating plug part can be produced in a particularly simple and rapid manner, and the plug part can be locked to the mating plug part. For locking purposes, the union nut only needs to be rotated through approximately one quarter to one half of a revolution for the thread turns of the thread to engage in one another and produce a screw connection.

One development of the invention provides for the plug part and the mating plug part to have, at their front sides, at least partially axially aligned toothed profiles. The toothed profiles are of complementary design and engage one inside the other when the plug-in connection is screwed; in the process they align the plug part and the mating plug part in the circumferential direction of the plug-in connection with respect to one another, without play. The profile sections may be formed on corresponding front faces or outer faces of the plug-in connection parts and have, for example, a sawtooth-shaped, trapezoidal or sinuous cross section. The toothed profiles connect the plug part and the mating plug part to one another in an interlocking and force-fitting manner, as a result of which any unintentional rotation of the plug part and the mating plug part with respect to one another is prevented when the union nut is tightened, and the electrical contact elements are protected against being damaged.

In one preferred embodiment of the plug-in connection according to the invention, the electrical contact elements in the plug part and the mating plug part are protected against moisture by seals. For this purpose, the plug part or mating plug part bearing the union nut has a first sealing ring on the front side of the plug part or mating plug part bearing the union nut and a second sealing ring in the region of the front faces of the union nut. The first sealing ring is radially pinched by the union nut when the union nut is tightened and is pressed against the body of the plug part or the mating plug part; it seals a first annular gap between the mating plug part or plug part and the union nut of the plug-in connection in the plugged-together and screwed state of the plug-in connection. When the union nut is plugged or screwed onto the plug part or mating plug part, the second sealing ring is pressed radially; it seals a second annular gap between the plug part or mating plug part and the union nut.

The union nut of the electrical plug-in connection is secured against being detached unintentionally, in particular owing to vibrations. For this purpose, a friction brake is provided on the plug part and/or the mating plug part bearing the union nut, which friction brake inhibits a rotary movement of the union nut. The elastic sealing rings, which radially seal the annular gaps between the plug part, the mating plug part and the union nut, act as a friction brake. The sealing rings are pressed against the inner surface of the union nut in an interlocking and force-fitting manner and fix the union nut by means of frictional force. In order to rotate the union nut, the frictional force between the friction brake and the union nut needs to be overcome.

BRIEF DESCRIPTION OF THE DRAWINGS

The invention will be explained in more detail below with reference to an exemplary embodiment illustrated in the accompanying drawing, in which:

FIG. 5 shows an enlarged detail of the plug part shown in FIG. 3 with a union nut screwed on.

DETAILED DESCRIPTION

Figure 1:
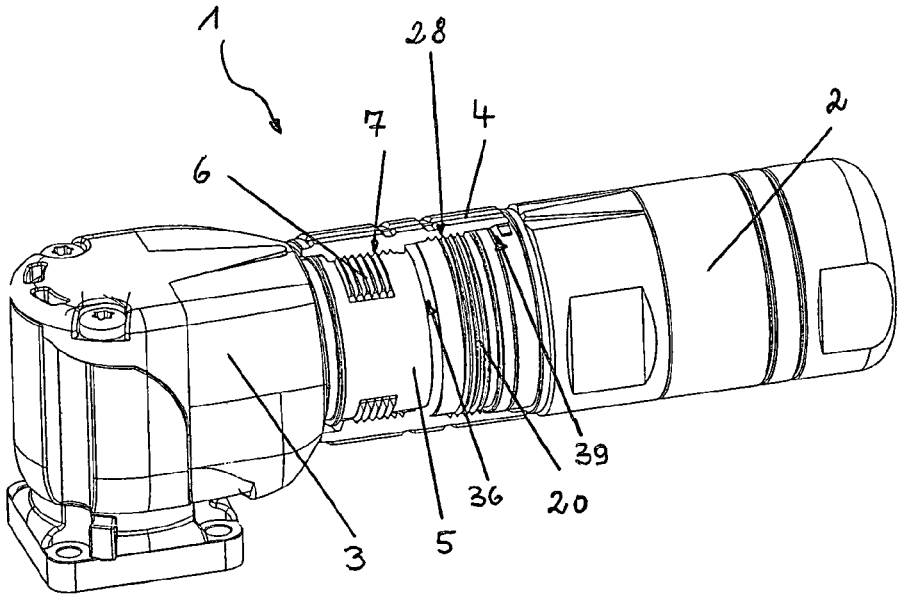
FIG. 1 shows a perspective view of the electrical plug-in connection according to the invention with a plug part and a mating plug part.
Figure 2:
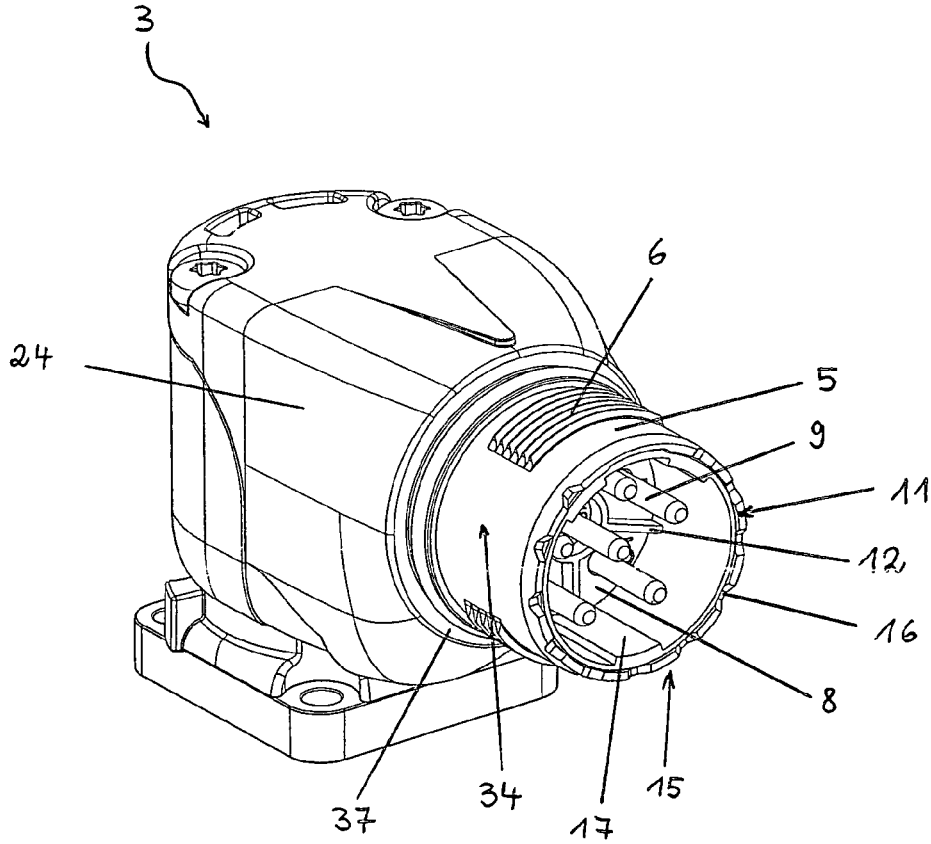
FIG. 2 shows a perspective view of the mating plug part shown in FIG. 1.

The plug-in connection 1 according to the invention and illustrated in FIG. 1 essentially comprises a plug part 2, a mating plug part 3 and a union nut 4. The plug part 2 is plugged together with the mating plug part 3 and is screwed to the mating plug part 3 by means of the union nut 4 borne by the plug part 2. The plug part 2 produces a large number of electrical connections to the mating plug part 3, which is fixed to a machine housing (not illustrated). The plug part 2 and the mating plug part 3 are shown individually, in the state in which they are not plugged together, in FIGS. 4 and 2.

Figure 5:
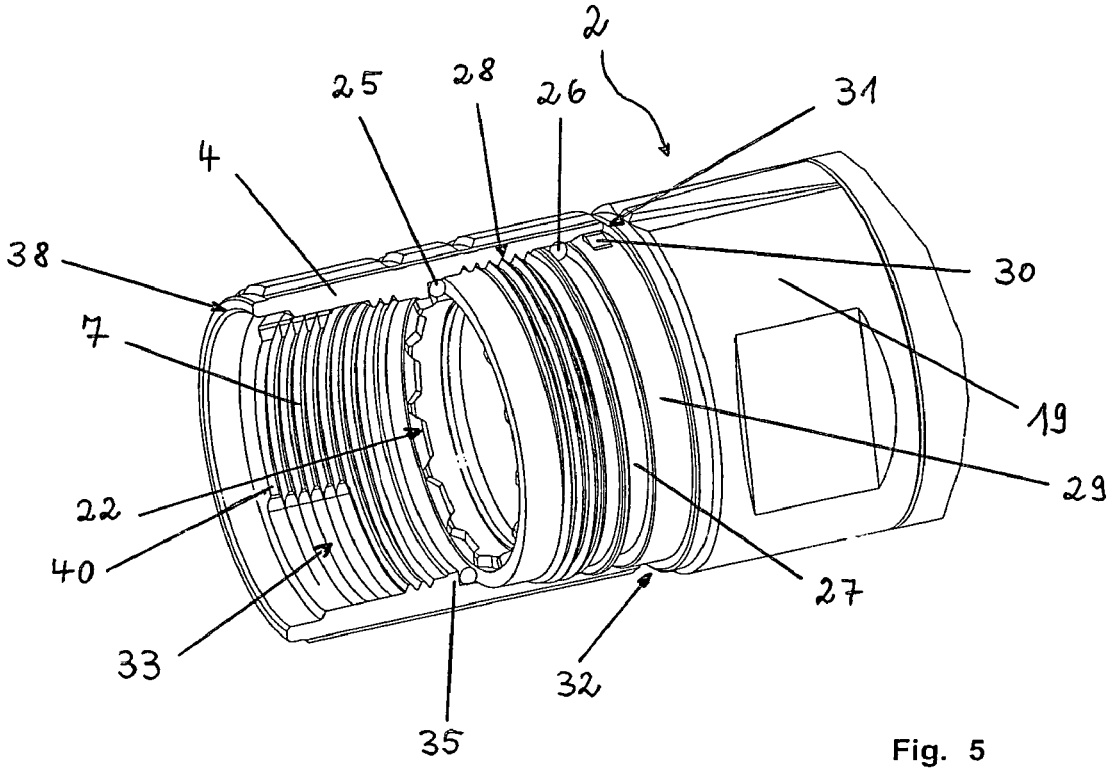

The mating plug part 3 has a thread sleeve 5 having an external thread 6. The external thread 6 has a plurality of thread turns and is of a segmented design. It has three thread-free regions 34 in the plug-in direction, which are arranged such that they are distributed asymmetrically over the circumference of the thread sleeve 5. An internal thread 7, which is equivalently matched to the segmented external thread 6 of the mating plug part 3, of the union nut 4 can be virtually completely inserted into said external thread 6, as is illustrated in FIG. 5. At most a quarter to one half of a revolution of the union nut 4 is required for tightening the union nut 4 on the mating plug part 3. A stop 37 for the union nut 4 is provided on that side of the external thread 6 which is remote from the plug part 2.

A contact carrier 8 consisting of an insulating material is arranged, recessed, on the front side of the mating plug part 3. It is fixed in the thread sleeve 5 with radial play. The contact carrier 8 has, as electrical contact elements, five male contact connectors 9 for the purpose of making contact with contact elements of the plug part 2 which are in the form of female contact connectors 10. The male contact connectors 9 extend up to the front face 11 of the thread sleeve 5. Alignment means 12 are provided on the front side of the contact carrier 8 facing the plug part 2 and engage in corresponding alignment means 13 of a contact carrier 14 of the plug part 2 when the plug-in connection 1 is plugged together. The alignment means 12, 13 align the contact carriers 8, 14 such that they are flush with one another in the radial direction. The alignment means 12, 13 are designed such that they do not impede the action of the plug part 2 or the mating plug part 3 being plugged together with conventional plug-in connectors.

A toothed profile 15 is formed on the front face 11 of the thread sleeve 5 in order to prevent the plug part 2 from rotating. The toothed profile 15 is aligned axially and comprises a large number of trapezoidal cutouts 16 in the front face 11. The cutouts 16 are distributed evenly over an annular region of the front face 11. A web 17, which, in conjunction with an axially extending groove 18 of the contact carrier 14 of the plug part 2, forms polarity reversal protection for the electrical connections of the plug-in connection 1, is arranged in the axial direction on the inside of the thread sleeve 5.

Figure 3:
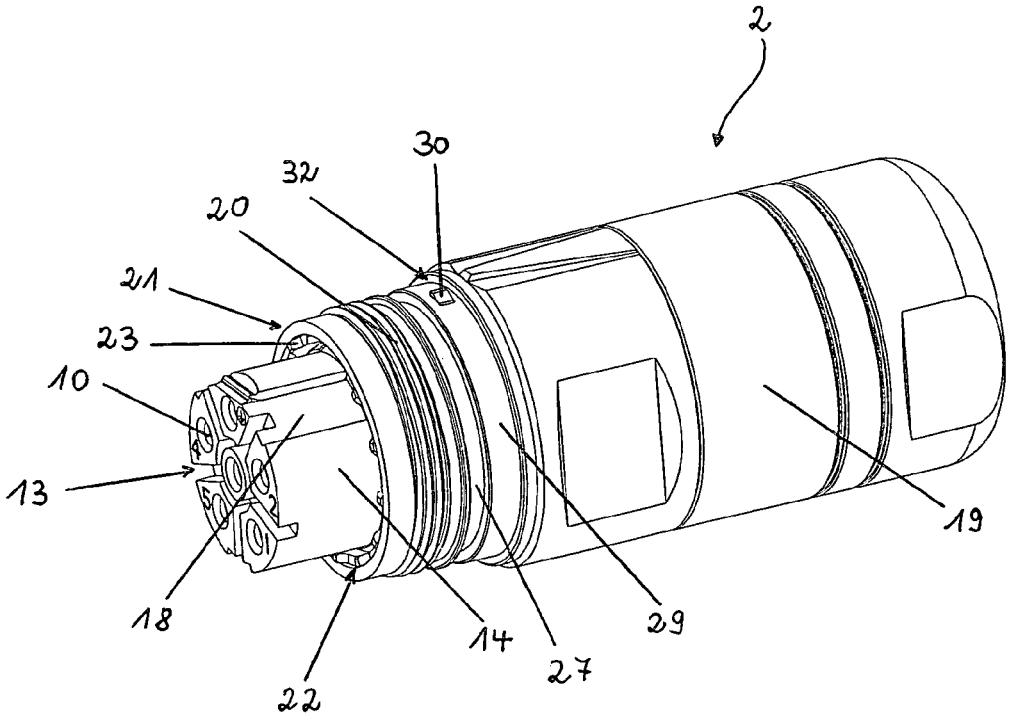
FIG. 3 shows a perspective view of the plug part shown in FIG. 1 with a full thread as the external thread for the union nut.
Figure 4:
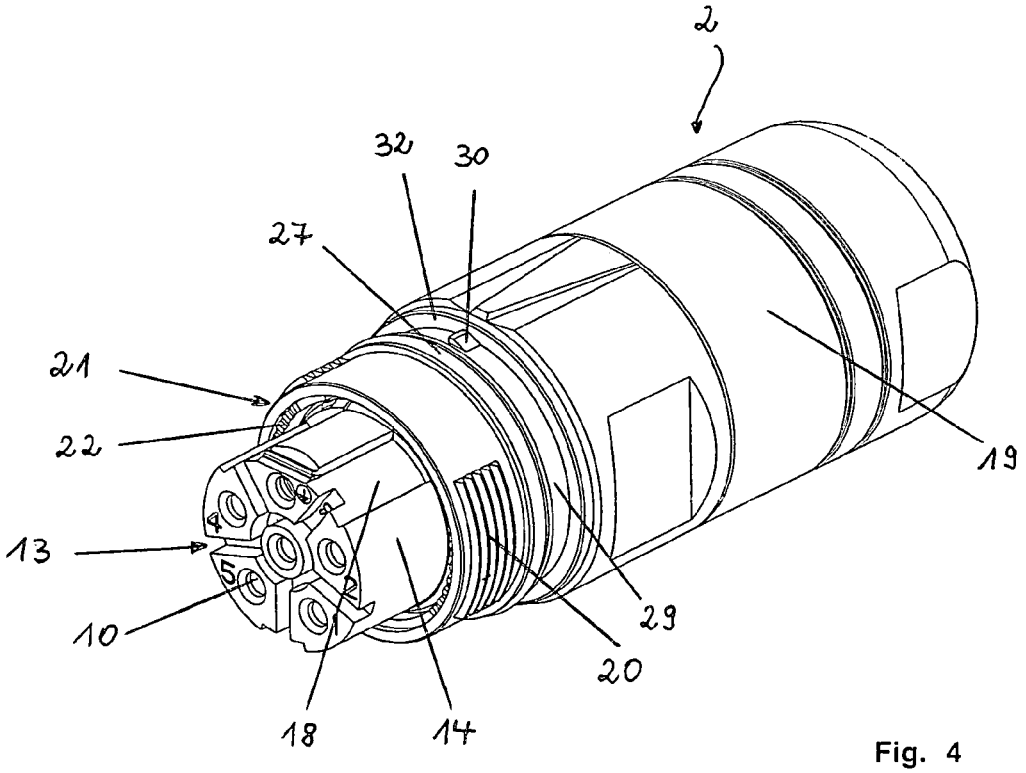
FIG. 4 shows a perspective view of one variant of the plug part shown in FIG. 3 with a segmented thread as the external thread for the union nut.

FIGS. 3 and 4 show the plug part 2, which is designed at the front to be complementary to the mating plug part 3. The contact carrier 14 protrudes in the axial direction over the body 19 of the plug part 2 and can be inserted into the thread sleeve 5 of the mating plug part 3. It has five female contact connectors 10, which make contact with the male contact connectors 9 of the mating plug part 3 in the inserted state of the plug part 2.

The body 19 of the plug part 2 has, on its side pointing towards the mating plug part 3, an external thread 20 for screwing to the union nut 4. The external thread 20 may be in the form of a full thread (illustrated in FIG. 3) or in the form of a segmented thread (illustrated in FIG. 4). If the external thread 20 is in the form of a full thread, the union nut is screwed to the plug part 2 by means of a plurality of revolutions. If the external thread 20 is designed to be similar to the external thread 6 of the mating plug part 3, the union nut 4 can be plugged onto the external thread 20. The tightening of the union nut 4 is reduced to approximately one quarter of a revolution.

A front face 21 of the plug part 2 is opposite the front face 11 of the mating plug part 3. In an inner annular face, the front face 21 bears a toothed profile 22, which is of complementary design with respect to the toothed profile 15 of the thread sleeve 5 of the mating plug part 3. In the case of a plugged-together and screwed plug-in connection 1, projections 23 of the toothed profile 22 engage into the cutouts 16 in the toothed profile 15 and prevent the plug part 2 from rotating with respect to the mating plug part 3. The front face 21 is designed to be smooth and flat in an outer annular area.

A first elastic sealing ring 25 for sealing a first annular gap 36 between the thread sleeve 5 of the mating plug part 3 and the union nut 4 is arranged between an annular collar 35, which is provided centrally in the union nut 4, and the outer annular area of the front face 21 of the plug part 2. The sealing ring 25 is pinched when the union nut 4 is tightened and is pressed on the outside against the thread sleeve 5 of the mating plug part 3 and against the union nut 4 of the plug part 2. The sealing ring 25 radially seals the annular gap 36 of the plug-in connection 1 in the screwed state of the plug-in connection.

The plug part 2 bearing the union nut 4 has a second elastic sealing ring 26, which is arranged at that end of the external thread 20 of the plug part 2 which is remote from the front face 21 of the plug part 2. The O ring 26 rests in an annular groove 27 of the body 19 of the plug part 2. It radially seals a second annular gap 39 between the union nut 4 and the body 19 of the plug part 2 in the region of the front face 31 of the union nut 4.

O rings are provided as sealing rings 25, 26, are produced from an elastic material having rubber-like properties and have a high coefficient of friction. The O rings 25, 26 are pressed against the union nut 4 and act as a friction brake between the plug part 2, the mating plug part 3 and the union nut 4. They inhibit a rotation of the union nut 4 by means of their frictional forces and prevent the union nut 4 from becoming detached by means of vibrations. The O rings 25, 26 protect the male contact connectors 9 of the mating plug part 3 and the female contact connectors 10 of the plug part 2 against moisture when the plug-in connection 1 has been screwed.

FIG. 5 shows that end of the plug part 2 which faces the mating plug part 3 with a union nut 4 screwed to the plug part 2. The external thread 20 of the plug part 2 is in the form of a full thread. It is in engagement with the plug-side internal thread 28 of the union nut 4. The internal thread 28 may be in the form of a full thread or a segmented thread, since both embodiments of the internal thread 28 can be combined with the external thread 20, which is in the form of a full thread, of the plug part 2.

When the plug-in connection 1 is screwed, the front face 31 of the union nut 4 approaches the stop 32 of the plug part 2, and the front face 38 of the union nut 4 approaches the stop 37 of the mating plug part 3. The union nut 4 can be rotated until the flanks of the toothed profile 15 of the thread sleeve 5 of the mating plug part 3 and the flanks of the toothed profile 22 of the body 19 of the plug part 2 bear against one another.

A latching section 30 is integrally formed on an annular collar 29 of the body 19 of the plug part 2, engages in a guide (not illustrated) of the union nut 4 and locks the union nut 4 to the plug part 2 such that it can rotate. The latching section 30 protects the plug part 2 against the loss of the union nut 4. The latching section 30 is effective if the front face 31 of the union nut 4 is still only approximately one quarter to one whole revolution away from the stop 32 of the plug part 2. Once the latching section 30 has been snapped in, the union nut 4 can be screwed tight or detached only by approximately one quarter of a revolution to one whole revolution.

The internal thread 7, which points towards the mating plug part 3, of the union nut 4 is of segmented design. Its design is equivalent to the segmented external thread 6 of the thread sleeve 5. The internal thread 7 of the union nut 4 has recesses 33, with which it is possible for it to be plugged onto the external thread 6 of the mating plug part 3. Correspondingly, the recesses 34 of the external thread 6 of the mating plug part 3 (not illustrated in FIG. 5) overlap the internal thread 7 of the union nut 4 on the side facing the mating plug part 3. A first thread turn 40 of the internal thread 7 of the union nut 4 has a cross-sectional profile which is different than the external thread 6 of the thread sleeve 5 of the mating plug part 3. The thread turn 40 of the internal thread 7 cannot be brought into engagement with the thread turns of the external thread 6, which ensures that the plug part 2 can only be screwed to the mating plug part 3 when the contact carrier 14 of the plug part 2 has been completely inserted into the thread sleeve 5 of the mating plug part 3.

Owing to the opposing internal thread 28, 7 of the union nut 4, the plug part 2 and the mating plug part 3 are moved towards one another, the annular gap 36 between the body 19 of the plug part and the body 24 of the mating plug part 3 being reduced in terms of its width when the union nut 4 is rotated twice as quickly as is the case with a conventional union nut 4 with only one internal thread 7 associated with the mating plug part 3. Consequently, the electrical plug-in connection 1 can be produced in a reliable and precisely positioned manner, even in the case of a plug part 2 and/or mating plug part 3 which is subject to relatively high tolerances, by the union nut 4 being tightened at a predetermined angle of rotation.

The invention claimed is:

1. Electrical plug-in connection (1), having a plug part (2) and a mating plug part (3), comprising female contact connectors (10) and male contact connectors (9) which can be plugged together and produce a large number of electrical connections, whereby the plug part (2) or the mating plug part (3) is bearing a union nut (4) on its body (19, 24) being pivot-mounted, which can be screwed to the mating plug part (3) or the plug part (2) and secures the plug-in connection (1) against being disconnected in an undesirable manner, the union nut (4) having, at both of its ends, an internal thread (28, 7) for screwing it to the plug part (2) and the mating plug part (3), and the internal threads (7, 28) being formed in the opposite direction and having a consistent thread diameter, characterized in that at least one of the two internal threads (7, 28) of the union nut (4) is segmented in a circumferential direction and has on the side facing the front faces (31, 38) of the union nut (4) a first thread segmented turn (40) having a cross-sectional profile which is different than the thread turns of the external threads (6, 20) and cannot be brought into engagement with the thread (6, 20) of the mating plug part (3) or the plug part (2), whereby the segmented internal thread (7) respectively (28) of the union nut (4) has at least one threaded and one threadless region, which extends in the plug-in direction, wherein its threaded region can be inserted completely into a threadless region of an external thread (6, 20) of the associated plug part (2) or mating plug part (3) having a complimentary design, and screwing union nut (4) is impossible as long as its segmented turn (40) is positioned within the threadless region of the plug part (2) respectively of the mating plug part (3).

2. Plug-in connection according to claim 1, characterized in that the union nut (4) is fixed on the body (19, 24) of the bearing plug part (2) or mating plug part (3) such that it can be rotated and displaced.

3. Plug-in connection according to claim 1, characterized in that the plug part (2) and the mating plug part (3) have, on their front sides, at least partially axially aligned toothed profiles (22, 15), which engage one inside the other when the plug-in connection (1) has been screwed and align the plug part (2) and the mating plug part (3) in the circumferential direction with respect to one another, without play.

4. Plug-in connection according to claim 1, characterized in that the plug part (2) and the mating plug part (3) have external threads (20, 6) on their body (19, 24) which are designed to be complementary with respect to the threads (28, 7) of the union nut (4).

5. Plug-in connection according to claim 4, characterized in that the union nut (4) is fixed on the body (19, 24) of the bearing plug part (2) or mating plug part (3) such that it can be rotated and displaced.

6. Plug-in connection according to claim 1, characterized in that at least the plug part (2) or mating plug part (3) bearing the union nut (4) has a first elastic sealing ring (25) with rubber-like properties, which is arranged on the front side of the plug part (2) or the mating plug part (3) and is pinched by the union nut (4) when tightened and radially seals a first annular gap (36) between the union nut (4) and the body (24) of the mating plug part (3) or the body (19) of the plug part (2).

7. Plug-in connection according to claim 6, characterized in that the sealing rings (25, 26), which are pressed against the body (19) of the plug part (2), against the body (24) of the mating plug part (3) and against the union nut (4), act as a friction brake for the union nut (4) and prevent the union nut (4) from becoming detached owing to vibrations.

8. Plug-in connection according to claim 1, characterized in that at least the plug part (2) or mating plug part (3) bearing the union nut (4) has a second elastic sealing ring (26) with rubber-like properties, which is arranged at that end of the external thread (20) of the plug part (2) or the external thread (6) of the mating plug part (3) which is remote from the front side of the plug part (2) or the mating plug part (3) and radially seals a second annular gap (39), between the union nut (4) and the body (19) of the plug part (2) or the body (24) of the mating plug part (3), in the region of the front faces (31, 38) of the union nut (4).

9. Plug-in connection according to claim 8, characterized in that the sealing rings (25, 26), which are pressed against the body (19) of the plug part (2), against the body (24) of the mating plug part (3) and against the union nut (4), act as a friction brake for the union nut (4) and prevent the union nut (4) from becoming detached owing to vibrations.

10. Electrical plug-in connection (1), having a plug part (2) and a mating plug part (3), comprising female contact connectors (10) and male contact connectors (9) which can be plugged together and produce a large number of electrical connections, wherein the plug part (2) or the mating plug part (3) carries a union nut (4) on its body (19, 24), wherein the union nut can be screwed to the mating plug part (3) or the plug part (2) and secures the plug-in connection (1) against being disconnected in an undesirable manner, the union nut (4) having, at both of its ends, an internal thread (28, 7) for screwing it to the plug part (2) and the mating plug part (3), and the internal threads (7, 28) being formed in the opposite direction, characterized in that at least one of the two internal threads (7, 28) of the union nut (4) is segmented in a circumferential direction and has on the side facing the front faces (31, 38) of the union nut (4) a first thread segmented turn (40) having a cross-sectional profile which is different than and will not fit within the thread turns of the external threads (6, 20), wherein the segmented internal thread of the union nut (4) has at least one threaded and one threadless region which extends in the plug-in direction, wherein the threaded region can be inserted completely into a threadless region of an external thread (6, 20) of the associated plug part (2) or mating plug part (3) having a complimentary design, and wherein screwing of union nut (4) is impossible as long as its segmented turn (40) is positioned within the threadless region of the plug part (2) respectively of the mating plug part (3).

* * * * *